US010287734B2

(12) United States Patent
Herzberg

(10) Patent No.: US 10,287,734 B2
(45) Date of Patent: May 14, 2019

(54) ROAD PAVER WITH SUPPORT DEVICE

(71) Applicant: JOSEPH VOEGELE AG, Ludwigshafen/Rhein (DE)

(72) Inventor: Ingo Herzberg, Angelbachtal (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 0 days.

(21) Appl. No.: 15/480,866

(22) Filed: Apr. 6, 2017

(65) Prior Publication Data

US 2017/0292231 A1 Oct. 12, 2017

(30) Foreign Application Priority Data

Apr. 8, 2016 (EP) ..... 16164470

(51) Int. Cl.

| | |
|---|---|
| ***E01C 19/42*** | (2006.01) |
| ***E01C 23/01*** | (2006.01) |
| ***E01C 19/00*** | (2006.01) |
| ***E01C 19/48*** | (2006.01) |

(52) U.S. Cl.

CPC ..... *E01C 19/42* (2013.01); *E01C 19/004* (2013.01); *E01C 19/48* (2013.01); *E01C 23/01* (2013.01); *E01C 19/4873* (2013.01); *E01C 2301/00* (2013.01)

(58) Field of Classification Search

CPC ..... E01C 19/42; E01C 19/004; E01C 19/48; E01C 23/01; E01C 2301/04; E01C 2301/20; E01C 2301/10; E01C 19/4873

See application file for complete search history.

(56) References Cited

U.S. PATENT DOCUMENTS

| | | | | |
|---|---|---|---|---|
| 3,282,377 A | | 11/1966 | Pfeiffer et al. | |
| 3,710,695 A | | 1/1973 | Miller et al. | |
| 4,543,006 A | * | 9/1985 | Wang | E06C 1/32 16/332 |

(Continued)

FOREIGN PATENT DOCUMENTS

| | | |
|---|---|---|
| CN | 102828458 A | 12/2012 |
| CN | 102828459 A | 12/2012 |

(Continued)

OTHER PUBLICATIONS

European Search Report dated Oct. 12, 2016, Application No. EP 16164470.3-1604, Applicant Joseph Voegele AG, 6 Pages.

(Continued)

*Primary Examiner* — Abigail A Risic

(74) *Attorney, Agent, or Firm* — Brooks Kushman P.C.

(57) ABSTRACT

A road paver with a height-adjustable screed for installing a pavement layer and at least one support device for carrying and positioning at least one sensor unit is provided. The support device comprises a center bar, at least one extension bar for the center bar, and at least one attachment unit which detachably attaches the extension bar at one end of the center bar. The center bar and the extension bar are by way of the attachment unit relative to one another—when viewed in the vertical projection plane—at a first mounting angle connectable to one another, and the center bar and the extension bar are by way of the attachment unit connectable to one another—when viewed in the vertical projection plane—at at least one further mounting angle.

20 Claims, 4 Drawing Sheets

(56) References Cited

U.S. PATENT DOCUMENTS

| | | | | | |
|---|---|---|---|---|---|
| 5,058,239 | A * | 10/1991 | Lee | E06C 1/32 16/324 |
| 5,258,961 | A | 11/1993 | Sehr et al. | |
| 5,393,167 | A | 2/1995 | Fujita et al. | |
| 5,599,134 | A * | 2/1997 | Macku | E01C 19/008 404/84.1 |
| 5,975,473 | A * | 11/1999 | Haas | E01C 19/006 172/4 |
| 6,729,596 | B2 * | 5/2004 | Fumado Gilabert | E01C 19/004 248/550 |
| 8,702,344 | B2 | 4/2014 | Hanfland | |
| 9,032,983 | B2 * | 5/2015 | Jin | E04H 15/48 135/120.3 |
| 9,033,611 | B2 | 5/2015 | Hanfland et al. | |
| 2004/0056170 | A1 | 3/2004 | Fumado Gilabert | |
| 2014/0356050 | A1 * | 12/2014 | Yu | B62K 19/18 403/110 |
| 2017/0292230 | A1 | 10/2017 | Herzberg | |

FOREIGN PATENT DOCUMENTS

| | | | |
|---|---|---|---|
| CN | 203629600 | U | 6/2014 |
| CN | 207121792 | U | 3/2018 |
| DE | 69126017 | T2 | 11/1997 |
| DE | 60226237 | T2 | 5/2009 |
| EP | 1 403 434 | A1 | 3/2004 |
| EP | 3 228 747 | A1 | 10/2017 |
| JP | S56-082010 | U | 7/1981 |
| JP | S63-147003 | A1 | 6/1988 |
| JP | 2-261105 | A | 10/1990 |
| JP | 3-199501 | A | 8/1991 |
| JP | H4-41802 | | 2/1992 |
| JP | H4-4108904 | A | 4/1992 |
| JP | H4-179705 | A | 6/1992 |
| JP | H4-179710 | A | 6/1992 |
| JP | 4-77610 | A | 7/1992 |
| JP | 6-8410 | U | 2/1994 |
| JP | H7-127017 | A | 5/1995 |

OTHER PUBLICATIONS

Chinese Search Report dated Mar. 29, 2018, Application No. 2017101473241, 2 Pages.

Chinese Office Action dated Apr. 4, 2018, Application No. 201710147324.1, 3 Pages.

European Search Report dated Jun. 24, 2016, Application No. EP 16 16 4466, Applicant Joseph Voegele AG, 5 Pages.

European Search Report dated Sep. 13, 2017, Application No. 17163505.5-1614, Applicant Joseph Voegele AG, 7 Pages.

European Communication dated Jan. 31, 2018, Application No. 17 163 505.5-1002, Applicant Joseph Voegele AG, 5 Pages.

Japanese Office Action dated Jun. 20, 2017, Dispatch No. 261585, Application No. 2017-032345, 7 Pages.

Japanese Office Action dated Jun. 1, 2018, Dispatch No. 236817, Application No. 2017-075809, 3 Pages.

U.S. Office Action dated Apr. 17, 2018, U.S. Appl. No. 15/458,276, 32 Pages.

U.S. Notice of Allowance dated Nov. 13, 2018, U.S. Appl. No. 15/458,276, 13 Pages.

U.S. Office Action dated Dec. 27, 2018, U.S. Appl. No. 15/938,573, 29 Pages.

Amendment Under 37 C.F.R. 1.111 dated Jan. 31, 2019, U.S. Appl. No. 15/938,573 10 Pages.

Japanese Office Action dated Mar. 4, 2019, Application No. 2018-062582, 3 Pages.

* cited by examiner

ROAD PAVER WITH SUPPORT DEVICE

CROSS-REFERENCE TO RELATED APPLICATIONS

This application claims foreign priority benefits under 35 U.S.C. § 119(a)-(d) to European patent application number EP 16164470.3, filed Apr. 8, 2016, which is incorporated by reference in its entirety.

TECHNICAL FIELD

The present disclosure relates to a road paver with a support device.

BACKGROUND

Road pavers are in practice used to install new road surfaces by use of a screed arranged thereon. The paving material for this is taken from a material hopper of the road paver which is in the installation direction arranged at the front of the road paver. The paving material is via a material conveying device transported from the material hopper to the rear to the screed, spread out in front of the latter by use of a distribution auger and finally installed beneath the screed by use of heated compaction units to form the new road surface.

In order to be able to install a flat road pavement on the road bed on which the road paver moves, the screed is attached to the chassis of the road paver by way of height-adjustable screed beams. Leveling of the screed can be controlled by a control unit of the road paver. Leveling the screed there depends on the surface condition of the road bed or on the target thickness of the road pavement to be installed.

It is known that a measuring bar device is for leveling the screed of a road paver used in practice laterally along the road paver for supporting a plurality of height measuring sensors above the road bed as well as behind the screed. Leveling the screed can then be effected based on the readings of the height measuring sensors.

For example, DE 602 26 237 T2 shows a measuring bar device with beams arranged one above the other which can be telescoped along the road paver in order to position sensors for height measurement on the side of the road paver above the road bed. The respective telescopic bar segments can be attached at a desired location by way of anchors provided thereon. In addition, the respective height positions of the sensors can be adjusted. The drawback of this is that the telescopic measuring bars add large weight and can therefore only be used on special types of road pavers. In addition, several people are needed for mounting the measuring bar device on or for removing it from the road paver. In addition, the options with regard to the mounting height of the sensors are limited.

U.S. Pat. No. 5,975,473 A discloses a measuring bar device mounted laterally on a road paver. The measuring bar device is by articulated pivot arms attached to a screed beam of the road paver. Furthermore, the measuring bar device comprises a measuring bar supported laterally along the road paver and having a center bar as well as extension bars attached to the ends thereof. Attached to the center bar and to the extension bar are respective height measuring sensors. The respective extension bars can be pivoted inwardly relative to the center bar in the horizontal plane so that the sensor at the rear of the road paver attached to the rear extension bar can be positioned above the newly installed pavement layer behind the screed. In this measuring bar device, the respective segments connected to each other in an articulated manner are coupled by way of threaded screw connections. Assembly is therefore very complex and time-consuming. In addition, different clamping forces act upon the respective threaded screw connections, which ultimately depends on the operator adjusting the support device. This makes mounting and adjustment of the support device more difficult and does not make it easy to assemble for everyone. In addition, it is not uncommon for such a complex measuring bar device that individual components, in particular, loose screw levers, screws and clamps are lost at the construction site. Finally, the options for adjusting respective height positions for the sensors are in this measuring bar device limited.

DE 691 26 017 T2 discloses a road paver with a measuring bar attached thereto which is configured to be rigid and positioned above the road bed on the side of a screed beam of the road paver. A disadvantage of this is that the measuring bar can due to its rigid configuration be used, in particular, only on a limited number of types of road pavers.

SUMMARY

In view of the conventional solutions according to prior art, an object of the disclosure is to provide a road paver with a support device which is suitable for particularly flexible employment to be used on different road pavers, is characterized by simple and rapid mounting on the road paver and can additionally be used for a plurality of support options for modules attached thereto, in particular measuring units.

A road paver according to the disclosure comprises a height-adjustable screed for installing a pavement layer and at least one support device for carrying and positioning at least one sensor unit. The support device comprises a center bar, at least one extension bar for the center bar, and at least one attachment unit detachably attaching the extension bar to one end of the center bar. The center bar and the extension bar can by use of the attachment unit be connected to each other in the vertical projection plane relative to one another at a first mounting angle. The center bar and the extension bar can according to the disclosure by use of the attachment unit be connected to each other in the vertical projection plane at at least one further mounting angle.

There are therefore at least two attachment options for the extension bar at the end of the center bar so that the support device can be assembled individually depending on the application. This results in the possibility that the support device can be easily used on different types of road pavers in order to position the sensor unit carried thereby in dependence of the application at a variable height above the road bed or above the newly installed pavement layer.

In the disclosure, the sensor units used on the support device can depending on the application be aligned arbitrarily with respect to different measuring references or measuring positions, respectively. As a result, the support device can be used in a variety of applications, depending on the customer's demands. In particular, the respective sensors can in the disclosure be positioned in a particularly diverse manner. The attachment unit is in the disclosure configured for different assembly options for the center bar and the extension bar. As a result, the possible cases of applications for the support device are broadened, whereby it can be employed in particular as a standard module on different types of road pavers. Due to the adjustability in the vertical plane, the support device can be used very well on both large and small road pavers. This also promotes the use of different sensor types.

The support device preferably has the respective limbs and apex points of the first and the further mounting angle located in a vertical plane.

The support device preferably comprises at least one additional extension bar and one further attachment unit, where the additional extension bar is by way of the further attachment unit detachably attached to another end of the center bar or at the already existing extension bar. Due to the additional extension bar, the support device can be extended to a sufficiently long length in order to obtain a large measuring distance over the road bed by way of the support device.

In the disclosure, different carrying arm can be assembled and expanded as desired modules in a horizontal extension and vertical projection plane. In particular, a carrying bar, being rectilinear beyond the center bar up to the free ends of the extension bar coupled thereto, and a step-shaped carrying bar module can be assembled, comprising extension bars that are arranged offset in the vertical plane relative to one another. However, the assembly with two step-shaped extensions leading to the front and the rear from the center bar would also be conceivable in order to carry the foremost and rearmost extension bar close to the road bed. The center bar could in such a variant be attached to the road paver in the vertical plane displaced upwardly, in particular, horizontally.

According to a further embodiment, the two extension bars can be attached to the ends of the center bar running parallel to one another at a defined distance from one another. As a result, the two extension bars together with the center bar form a step shape, where the extension bars extend at a certain distance from one another. Sensors of the sensor unit can by way of this bar assembly be positioned in a particular versatile manner at different heights relative to the road bed or to the road pavement installed, respectively. The sensors can in particular be easily positioned behind the screed at a prescribed minimum height above the hot road pavement. As a result, the sensors could be better protected behind the screed against ascending vapors and heat.

The step shape also promotes the fact that a sensor unit can be positioned above the road bed on which the road paver moves at the same height distance as a different sensor unit above the newly installed pavement layer.

The stepped structure, however, offers the substantial advantage—in particular, when installing large paving work—that the support device does not collide with other components of the road paver, for example, screed extension members, channel plates and/or supports for them. When installing large pavement widths, extension members of the screed and/or channel plates, which are—when viewed in the direction of travel—arranged in front of the extension members, can be secured vertically and horizontally by use of supporting rods projecting outwardly. The stepped structure of the support device there enables the use of such support rods, whereby the support device is itself not impaired in its function by the support rods. According to a further variant of the disclosure, the center bar is attached to a screed beam or on a side plate of the screed, in particular on a side plate of a screed extension member for broadening the screed. When attached to the side slide, a motion of the screed beam would at least not act directly on the support device. Attaching the support device to the side plate would furthermore have the advantage that the support device, irrespective of whether it is arranged in a step-shaped or rectilinear manner, does not obstruct the above-mentioned support rods.

Being attached to the screed beam, the height measurements could be conducted closer to the road paver. The respective attachment unit preferably comprises a hook-in jaw and a locking plate. The locking plate can be simply and quickly hooked on and fastened to the hook-in jaw of the attachment unit in order to be positioned thereon. In addition, neither the hook-in jaw nor the locking plate for coupling the latter to each other contain loose components, which benefits use at the construction site.

The locking plate and the hook-in jaw can then in a particularly fast and stable manner be aligned with one another in a desired assembly position if several hooks are formed on the locking plate and several bolts on the hook-in jaw for hooking in the hooks. Incorrect assembly is then not possible. In addition, the assembly can be performed without tools.

For stable alignment of an extension bar to the center bar or of two extension bars, the hook-in jaw of the respective attachment unit comprises a first and a second side wall, where the bolts extend between the side walls. The two side walls quasi form a guide for the locking plate, so that the latter is properly coupled to the hook-in jaw. The two side walls can there prevent any movement in the horizontal plane between the center bar and an extension bar attached thereto or between two extension bars attached to adjoin one another. As a result, the support device can—in the paving direction as seen in the horizontal projection plane be guided rigidly at the side of the road paver.

Assembly of the extension bar at one end of the center bar and/or assembly of two extension bars at the first or by the further mounting angle can be carried out particularly easily if the hook-in jaw comprises a first and a second group of bolts, where the center bar and the extension bar can by coupling the hooks of the locking plate to the first group of bolts be attached to each other at the first mounting angle, and where the center bar and the extension bar are by coupling the hooks of the locking plate to the second group of bolts connected to one another by the further mounting angle. In this respect, also the extension bars can be coupled to one another. Depending on the assembly, the group of bolts and the hooks hooked thereonto make it easy for an operator to mount the support device properly on the road paver without the need for additional assistance from another person.

A further variant provides that the center bar comprises the hook-in jaw at both ends, and the extension bar at one end comprises the locking plate for coupling to one of the hook-in jaw of the center bar. If the center bar is during the assembly of the support device already attached to the road paver, then the extension bars can be easily hooked onto, aligned with and locked at the ends of the latter.

The versatile extension options of the center bar arise, in particular, by the fact that the two hook-in jaws are there configured to be mirror-inverted with respect to one another at the ends of the center bar. The two hook-in jaws are there primarily arranged relative to each other by a glide reflection at the ends of the center bar. The respective groups of bolts can thereby be arranged at the respective ends of the center bar offset relative to each other such that an extension bar can be installed at both ends of the center bar at the first as well as at the further mounting angle. The support device can thereby be quickly converted between a rectilinear and a step-shaped coupling of the respective bars.

The extension bar on its end facing away from the center bar preferably comprises a hook-in jaw or a further locking plate. In the former embodiment, a locking plate of a further extension bar can simply be hooked thereonto and aligned therewith. This is easily accomplished by one operator.

The first mounting angle is preferably 180° and the further mounting angle is an obtuse angle. As a result, the carrying bar module can be assembled in particular as a rectilinear coupling as well as in a step-like manner. These connection options are particularly suitable for attaching different types of screeds, in particular, to the screed beams specially designed for this.

The attachment unit for securing the extension bar to the center bar preferably comprises a locking bolt which is movable between a locking position and a release position. The locking bolt can in the locking position preferably be positioned relative to a bolt of the hook-in jaw such that a hook being hooked onto the bolt is secured. Releasing and locking the locking bolt can be carried out quickly and simply without tools by use of one hand, which contributes to the overall improved ergonomics of the support device.

The locking bolt can preferably be secured in the release position. For example, the locking bolt can in the release position be rotated to a release seat, which prevents the locking bolt from self-shifting back into the locking position.

The locking bolt can be held particularly reliably in the release position and in the locking position when it is preloaded in the locking position by way of a spring. The spring force upon the locking bolt reliably holds the latter in the locking position and also secures the locking bolt in the release seat when it is in the release position.

The sensor unit preferably comprises a plurality of sensors each of which performs distance measurement to the road bed on which the road paver is moving and/or distance measurement to the newly installed road pavement behind the screed. For this purpose, the respective sensors are preferably configured as laser and/or ultrasonic sensors. Automatic leveling of the screed can on the basis of the respective height measurements be carried out by way of a control device provided in the road paver in order to install a new level pavement on the road bed. The sensors can be positioned at various locations along the support device. Height adjustability of the respective sensors is improved, in particular, by the adjustability of the support device being upstream when viewed in the vertical projection plane.

The center bar and/or extension bar is preferably configured as an aluminum profile, in particular as an aluminum form profile As a result, the weight of the support device can be kept low. In addition, further modules can be attached thereto particularly well. Other materials for the center bar and/or the extension bar are also conceivable.

Preferably, the support device is—when viewed from the top view—configured rectilinearly along the direction of travel of the road paver. However, it would also be conceivable to configure the support device—when viewed from the top view—in a step-like manner in the horizontal projection plane, whereby the two extension bars—viewed in the horizontal projection plane—are fastened to one another parallel to the center bar. As a result, the sensors attached to the extension bar could be positioned to the road paver laterally at various distances.

Embodiments according to the present disclosure are described with reference to the attached drawings.

DETAILED DESCRIPTION

Figure 1:
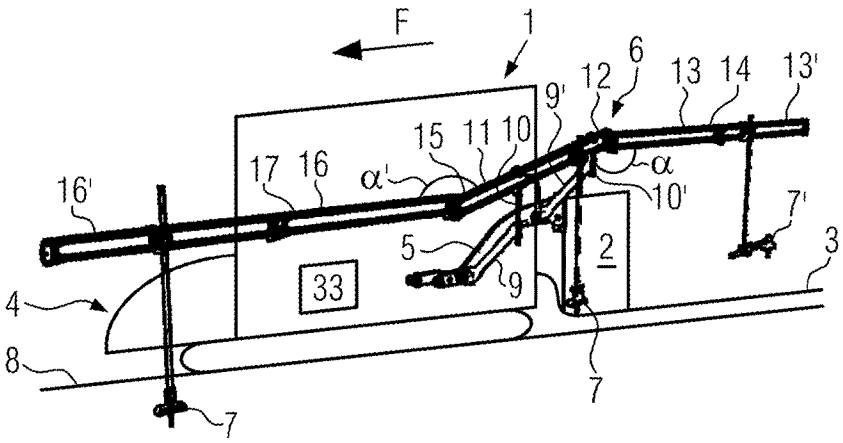
FIG. 1 shows a road paver according to the disclosure with a support device attached thereto.

Same components are throughout the figures designated with the same reference numerals.

FIG. 1 shows a road paver 1 with a towed screed 2. Screed 2 is configured to install a new pavement layer 3 onto a road bed 8. Road paver 1 further comprises a material hopper 4 from which the laying material is by way of a transport conveyor (not shown) running within road paver 1 transported to the rear to screed 2 for the installation of pavement layer 3.

Attached to a screed beam 5 of screed 2 is a support device 6. Support device 6 serves to carry and position at least one sensor unit 7. Sensor unit 7 is, in particular, configured to detect a distance to road bed 8 on which road paver 1 moves. A total of three sensor units 7 is in FIG. 1 arranged on support device 6, where the two sensor units 7—when viewed in the direction of travel F—being at the front each measure a distance to road bed 8 and sensor unit 7' disposed at the rear end of the support device measures a distance to the new pavement layer 3. Based on the height measurements to road bed 8 and/or to the new pavement layer 3, road paver 1 can by way of a control device 33 perform automatic leveling of screed 2.

Support device 6 comprises a first and a second pivot arm 9, 9', by way of which the former is attached to screed beam 5 of road paver 1. Attached to the ends of respective pivot arm 9, 9' being laterally offset outwardly relative to screed beam 5 are respective clamping devices 10, 10' which are designed as quick-release fasteners and hold a center bar 11 of support device 6. Center bar 11 is in the direction of travel F of road paver 1 aligned in a forwardly inclined manner with respect to the horizontal direction.

Attached to an end 12 of center bar 11 in the direction of travel F being disposed at the rear is an extension bar 13 for center bar 11. Center bar 11 and extension bar 13 are—when viewed in the vertical projection plane—connected to each other at a first mounting angle $\alpha$ relative to one another. A further extension bar 13' is attached further rearwardly on an end 14 of extension bar 13 facing away from center bar 11 for carrying sensor unit 7' above new pavement layer 3. The two extension bars 13, 13' are aligned horizontally relative to road bed 8 or to pavement layer 3 paved thereon.

Attached to an end 15 of center bar 11 in the direction of travel F being disposed at the front is an additional front extension bar 16, which is along its length extended by a further front extension bar 16' on which sensor unit 7 is carried above road bed 8. Center bar 11 and additional front extension bar 16 are coupled relative to one another at a mounting angle α', where mounting angle α' and first mounting angle α are alternate angles, as a result of which extension bar 13 and additional front extension bar 16 are according to FIG. 1 arranged parallel to one another as bar segments in support device 6.

Figure 2:
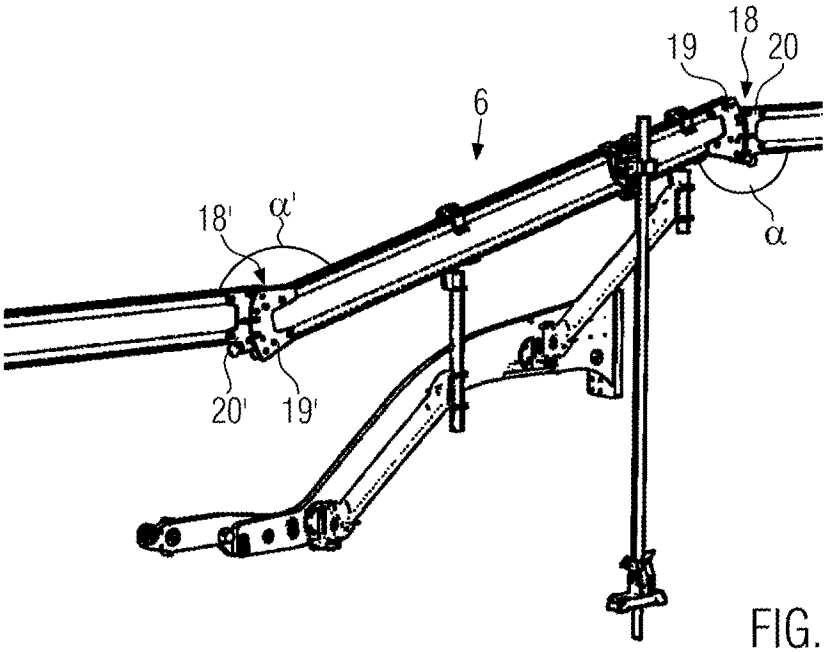
FIG. 2 shows an enlarged section of the support device according to FIG. 1.

FIG. 2 shows a section of support device 6 from FIG. 1. FIG. 2 shows that center bar 11 at each respective end 12, 15 comprises a respective attachment unit 18, 18' which connects extension bar 13 and additional front extension bar 16 to ends 12, 15 of center bar 11. The two extension bars 13, 16 are in FIG. 2 with center bar 11 arranged in a stepped manner and connected to one another by the alternating or Z-angles α, α'.

Figure 3:
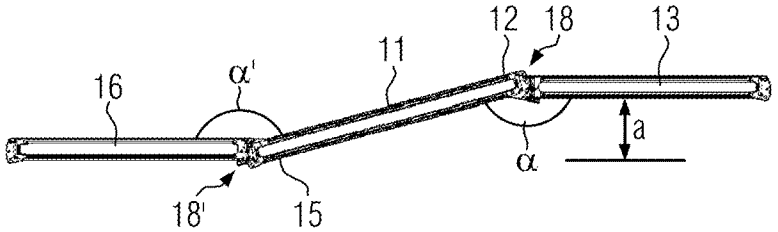
FIG. 3 shows a bar assembly in a step-shaped embodiment for the support device.

FIG. 3 shows only the step-like assembly of center bar 11 with extension bars 13, 16 attached to its respective ends 12, 15. Mounting angles α, α' are given as alternate angles, i.e., Z-angles, because the two extension bars 13, 16 are running parallel to one another through center bar 11.

Figure 4:
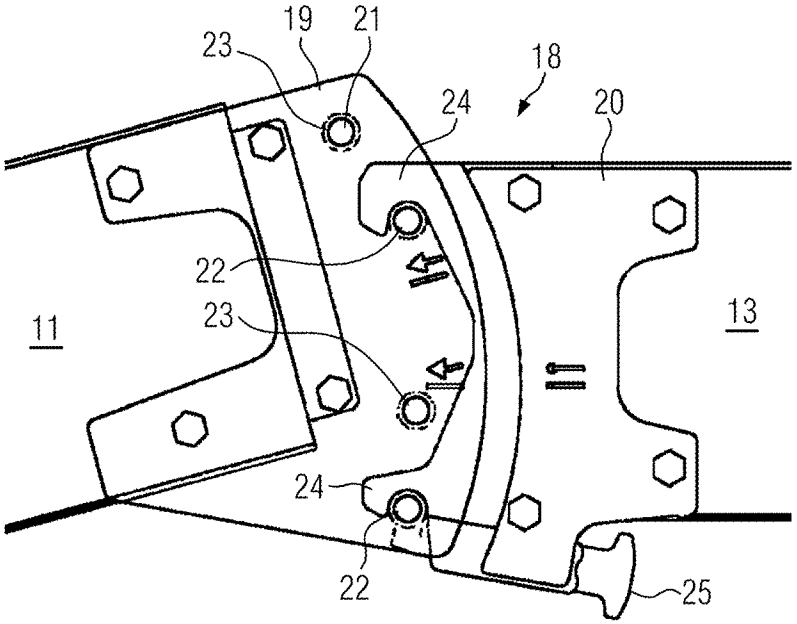
FIG. 4 shows an upper coupling point for the bar assembly from FIG. 3.

FIG. 4 shows attachment unit 18 in an enlarged view which attaches extension bar 13 to rear end 12 of center bar 11. Attachment unit 18 comprises a hook-in jaw 19 which is formed on center bar 11 and a locking plate 20 which is formed on extension bar 13. Locking plate 20 of extension bar 13 is attached to hook-in jaw 19 of center bar 11 in such a manner that center bar 11 and extension bar 13 are—as seen in the vertical projection plane—connected relative to one another at first mounting angle α.

FIG. 4 further shows that hook-in jaw 19 comprises a plurality of bolts 21 which are divided into a first group 22 and a second group 23 of bolts 21. Locking plate 20 disposes of two hooks 24 which are attached to first group 22 of bolts 21. The fastening of hooks 24, 24' to first group 22, 22' of bolts 21, 21' at the respective attachment units 18, 18' results in the formation of a stepped shape between the center bar and the extension bars attached thereto (see FIGS. 4 and 5). The hooking on to the second group 23, 23' of bolts 21, 21', on the other hand, results in a rectilinear beam assembly (see FIGS. 7 and 8).

Hook 24 in FIG. 4 being formed at the bottom locking plate 20 is secured against lower bolt 21 of first group 22 of bolts 21 by way of a locking bolt 25.

Figure 5:
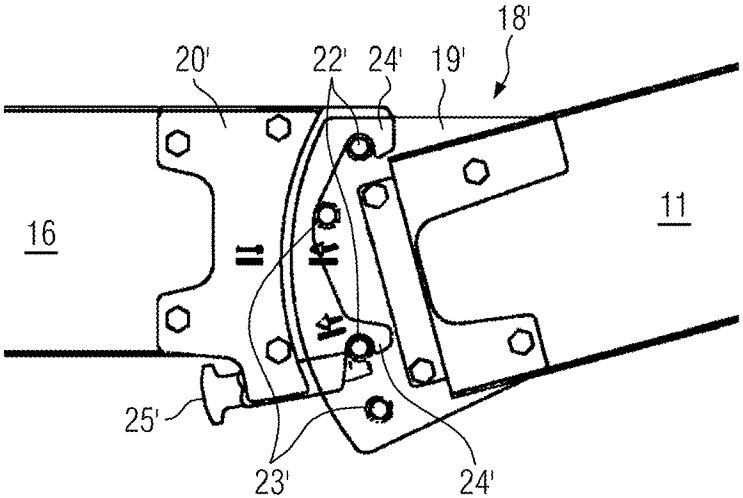
FIG. 5 shows a lower coupling point for the bar assembly from FIG. 3.

FIG. 5 shows a further attachment unit 18' which is formed at front end 15 of center bar 11. Attachment unit 18' at front end 15 of center bar 11 comprises a hook-in jaw 19' on which a locking plate 20' is hooked in, which is formed on extension bar 16 and which by way of a locking bolt 25' formed thereon is secured to hook-in jaw 19'. Hook-in jaw 19' is in FIG. 5 configured as being mirror-inverted—when viewed in the vertical plane—relative to hook-in jaw 19 of FIG. 4. It is thereby achieved that center bar 11 can be connected to respective extension bars 13, 16 in a step-shaped and rectilinear manner. Locking plate 20' from FIG. 5 in analogy to FIG. 4 comprises two hooks 24' which are attached to a first group 22' of bolts 21' of hook-in jaw 19'.

Figure 6:
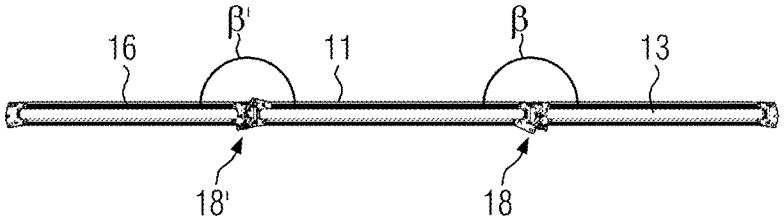
FIG. 6 shows a bar assembly in a rectilinear embodiment for the support device.

FIG. 6 shows the assembly of center bar 11 with the two extension bars 13, 16 in a rectilinear embodiment. Center bar 11 and extension bars 13, 16 are there connected to each other at a further mounting angle β, β'. Further mounting angle β, β' according to FIG. 6 is 180°, from which the rectilinear bar assembly arises.

Figure 8:
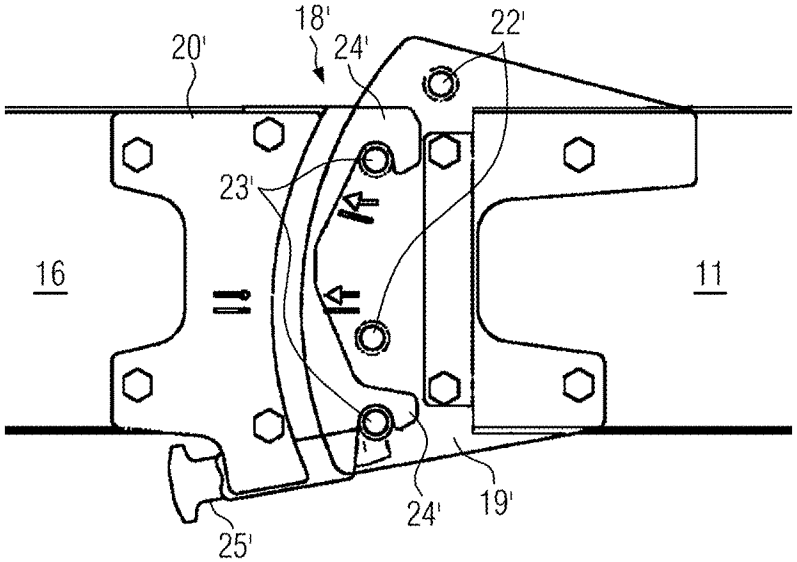
FIG. 8 shows a front coupling point for the bar assembly from FIG. 6.
Figure 7:
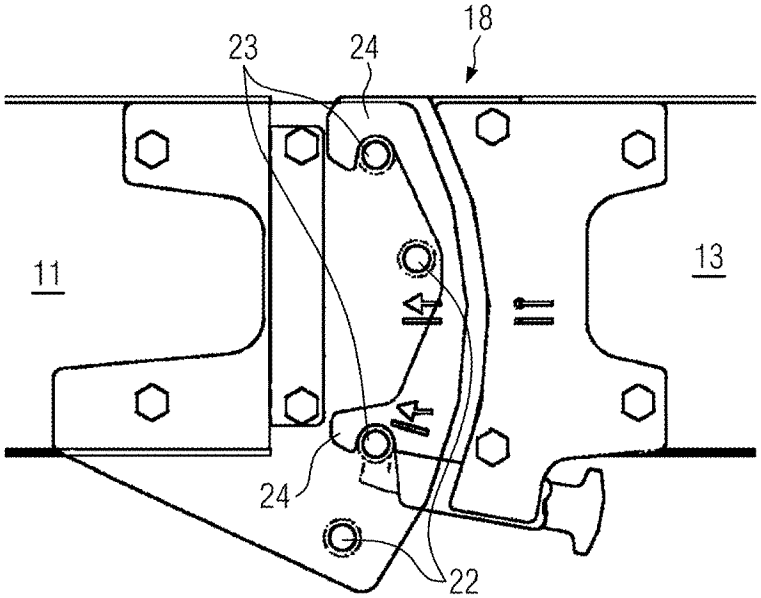
FIG. 7 shows a rear coupling point for the bar assembly from FIG. 6.

FIGS. 7 and 8 show the respective locking positions of attachment units 18, 18' according to FIG. 6.

In FIG. 7, locking plate 20 with hooks 24 provided thereon is attached to second group 23 of bolts 21 at hook-in jaw 19 of center bar 11. In contrast to FIG. 4, this mounting gives rise to a rectilinear assembly of center bar 11 with extension bar 13 according to further mounting angle β.

FIG. 8 shows attachment unit 18' formed at front end 15 of center bar 11, where hooks 24' are there as well attached to second group 23' of bolts 21'. The front end of center bar 11 can thereby also be connected in a rectilinear manner to additional extension bar 16.

Figure 9:
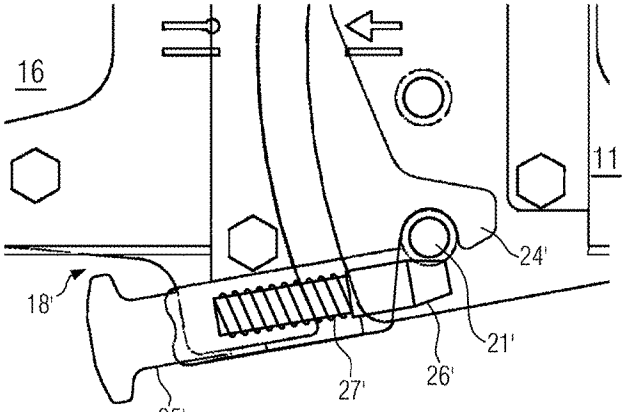
FIG. 9 shows a locking bolt in the locking position.

FIG. 9 shows attachment unit 18' from FIG. 8 in an enlarged view in the locking position. Locking bolt 25' is there positioned with its front end 26' below lower bolt 21' of second group 23' of bolts 21' in order to secure hook 24', which is at this point hooked in above bolt 21', to hook-in jaw 19'. Front end 26' of locking bolt 25' is preferably configured to be conical and, in particular, tapered in a region directly below bolt 21', so that locking bolt 25' does not twist when abutting bolt 21' when being in the locking position.

FIG. 9 also shows that locking bolt 25' is by a spring 27' pressed into the locking position.

Figure 10:
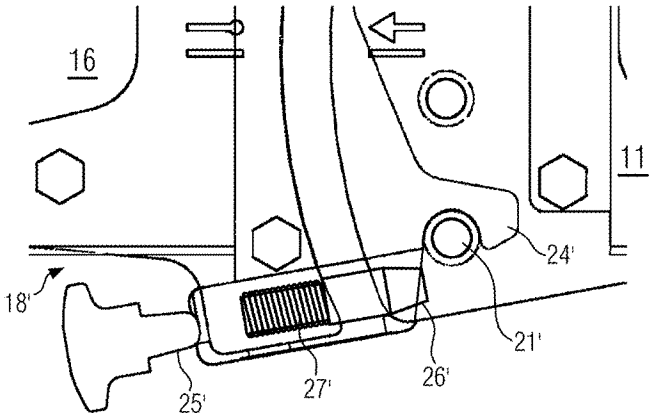
FIG. 10 shows the locking bolt from FIG. 9 in the release position.

FIG. 10 shows locking bolt 25' from FIG. 9 in a release position. In the release position, front end 26' of locking bolt 25' is below bolt 21' moved away laterally in order to release the lock of hook 24' at bolt 21'. In the release position, extension bar 16 can be unhooked from center bar 11. FIG. 10 also shows that locking bolt 25' is secured retracted in the release position in a release seat 28'. For this purpose, locking bolt 25' can by rotation about its mounting axis be moved to release seat 28', whereupon locking bolt 25' remains secured due to the spring force of spring 27'.

Figure 11:
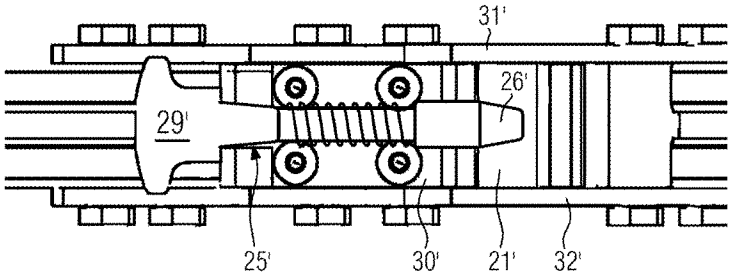
FIG. 11 shows a sectional view of the locking bolt in the locking position.

FIG. 11 shows a sectional view of the locking position of locking bolt 25' shown in FIG. 10. Locking bolt 25' is in FIG. 11 with its head 29' and with its front end 26' held in a guide 30'. Spring 27' presses front end 26' of locking bolt 25' with the tapered tip against bolt 21'. FIG. 11 also shows that locking bolt 21' of hook-in jaw 19' extends between a first side wall 31' and a second side wall 32'. First and second side walls 31', 32' together form a stable seat and guide for locking plate 20' so that the latter cannot swing out in the horizontal plane. It is thereby achieved that extension bar 16 fastened to center bar 11 remains positioned—when viewed in the horizontal plane—in a stable manner at the side of the road paver in the direction of travel F.

Figure 12:
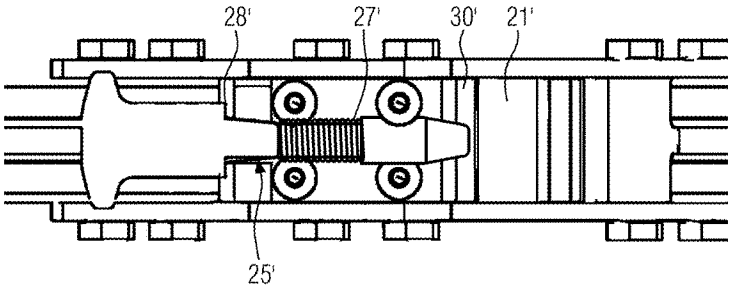
FIG. 12 shows a sectional view of the locking bolt in the release position.

FIG. 12 shows locking bolt 25' from FIG. 11 in the release position, where head 29' of locking bolt 25' is in comparison to the locking position rotated by 90° about the mounting axis seated on release seat 28' of guide 30'.

Although the support device has above been described exclusively on a road paver, it can also be attached to other vehicles, for example, to a charger vehicle for a road paver.

What is claimed is:

1. A road paver comprising:

a height-adjustable screed for installing a pavement layer; and a support device configured to carry and position at least one sensor unit, wherein the support device comprises a center bar, an extension bar for the center bar, and an attachment unit configured to detachably attach the extension bar at one end of the center bar, wherein the center bar and the extension bar are connectable to one another, by way of the attachment unit, at a first mounting angle relative to one another when viewed in a vertical projection plane oriented in a direction of travel of the road paver and extending upwardly with respect to the road paver, and wherein the center bar and the extension bar are, by way of the attachment unit, connectable to one another at at least one further mounting angle when viewed in the vertical projection plane.

2. The road paver according to claim 1 wherein the support device comprises an additional extension bar and a further attachment unit, wherein the additional extension bar is by way of the further attachment unit detachably attached to another end of the center bar.

3. The road paver according to claim 2 wherein the two extension bars are attachable to the center bar running parallel to one another at a defined distance.

4. The road paver according to claim 1 wherein the center bar is attached to a screed beam or to a side plate of the screed.

5. The road paver according to claim 1 wherein the attachment unit comprises a hook-in jaw and a locking plate.

6. The road paver according to claim 5 wherein hooks are formed on the locking plate, and bolts are formed on the hook-in jaw for hooking in the hooks.

7. The road paver according to claim 6 wherein the hook-in jaw comprises a first side wall and a second side wall, and wherein the bolts extend between the side walls.

8. The road paver according to claim 7 wherein the bolts of the hook-in jaw comprise a first group of bolts and a second group of bolts, wherein the center bar and the extension bar are connectable to each other at the first mounting angle by coupling the hooks of the locking plate to the first group of bolts, and wherein the center bar and the extension bar are connectable to one another at the further mounting angle by coupling the hooks of the locking plate to the second group of bolts.

9. The road paver according to claim 6 wherein the bolts of the hook-in jaw comprise a first group of bolts and a second group of bolts, wherein the center bar and the extension bar are connectable to each other at the first mounting angle by coupling the hooks of the locking plate to the first group of bolts, and wherein the center bar and the extension bar are connectable to one another at the further mounting angle by coupling the hooks of the locking plate to the second group of bolts.

10. The road paver according to claim 5 wherein the center bar comprise the hook-in jaw at one end, and an additional hook-in jaw at an opposite, and the extension bar at one end comprises the locking plate for coupling to one of the hook-in jaws of the center bar.

11. The road paver according to claim 10 wherein the two hook-in jaws are configured to be mirror-inverted with respect to one another at the ends of the center bar.

12. The road paver according to claim 10 wherein the extension bar comprises a hook-in jaw or a further locking plate at its end facing away from the center bar.

13. The road paver according to claim 1 wherein the first mounting angle is an obtuse angle and the further mounting angle is 180°.

14. The road paver according to claim 1 wherein the attachment unit for securing the extension bar to the center bar comprises a locking bolt which is movable between a locking position and a release position.

15. The road paver according to claim 14 wherein the locking bolt can be secured in the release position.

16. The road paver according to claim 14 wherein the locking bolt can by way of a spring be pressed to the locking position.

17. The road paver according to claim 5 wherein the attachment unit comprises a locking bolt which is movable between a locking position, for securing the extension bar to the center bar, and a release position.

18. The road paver according to claim 1 wherein the support device can be assembled without tools.

19. The road paver according to claim 1 wherein the center bar and the extension bar are oriented along the direction of travel of the road paver when the center bar and the extension bar are connected to one another by the attachment unit at the first mounting angle and at the at least one further mounting angle.

20. The road paver according to claim 2 wherein the two extension bars are attachable to the center bar so that the two extension bars are oriented along the direction of travel of the road paver, but at different heights.

* * * * *